US006055951A

United States Patent [19]

Rommer et al.

[11] Patent Number: 6,055,951

[45] Date of Patent: May 2, 2000

[54] CAM FOLLOWER OF A VALVE TRAIN OF AN INTERNAL COMBUSTION ENGINE IN THE FORM OF A FINGER LEVER OR A ROCKER ARM

[75] Inventors: Thomas Rommer, Hirschaid; Dieter Schmidt, Nuremberg, both of Germany

[73] Assignee: Ina Walzlager Schaeffler oHG, Germany

[21] Appl. No.: 09/194,006

[22] PCT Filed: Mar. 20, 1997

[86] PCT No.: PCT/EP97/01398

§ 371 Date: Nov. 16, 1998

§ 102(e) Date: Nov. 16, 1998

[87] PCT Pub. No.: WO97/45626

PCT Pub. Date: Dec. 4, 1997

[30] Foreign Application Priority Data

May 29, 1996 [DE] Germany ..... 196 21 463

[51] Int. Cl.[7] ..... F01L 1/26; F01L 1/24; F01L 1/18

[52] U.S. Cl. ..... 123/90.22; 123/90.4; 123/90.46; 74/559

[58] Field of Search ..... 123/90.22, 90.39, 123/90.4, 90.44, 90.45, 90.46; 74/519, 559

[56] References Cited

U.S. PATENT DOCUMENTS

| | | | |
|---|---|---|---|
| 4,638,774 | 1/1987 | Aoi | 123/90.22 |
| 5,463,988 | 11/1995 | Paul | 123/90.16 |
| 5,829,400 | 11/1998 | Speil et al. | 123/90.22 |

FOREIGN PATENT DOCUMENTS

| | | |
|---|---|---|
| 0237295 | 9/1987 | European Pat. Off. . |
| 3708675 | 9/1988 | Germany . |
| 4229411 | 3/1994 | Germany . |
| 4445218 | 10/1995 | Germany . |
| 59-023010 | 2/1984 | Japan . |

*Primary Examiner*—Weilun Lo
*Attorney, Agent, or Firm*—Bierman, Muserlian and Lucas

[57] ABSTRACT

A finger lever (1) is configured for the simultaneous loading of three identically operating gas exchange valves. To simplify the manufacture of a hydraulic medium supply of its hydraulic clearance compensation elements (4) resting on valve stem ends and to prevent unnecessary losses of hydraulic medium, the invention proposes the arrangement of only one central passage (12) in the finger lever (1) for supplying all the clearance compensation elements (4). This passage (12) extends near a central transverse plane of the finger lever (1) and opens into a cross-passage (10) in the form of a through-bore to the individual clearance compensation elements (4).

8 Claims, 2 Drawing Sheets

CAM FOLLOWER OF A VALVE TRAIN OF AN INTERNAL COMBUSTION ENGINE IN THE FORM OF A FINGER LEVER OR A ROCKER ARM

FIELD OF THE INVENTION

The invention concerns a cam follower of a valve train of an internal combustion engine in the form of a finger lever or a rocker arm.

BACKGROUND OF THE INVENTION

Such a cam follower is known, for example, from DE-OS 44 27 706. This is configured as a finger lever which is pivoted at one end on a pivot axis. This finger lever, or finger lever system, is provided in the prior art for the simultaneous loading of two gas exchange valves. Opposite the pivot axis in the lever system, there are positioned two hydraulic clearance compensation elements which act directly on identically operating gas exchange valves. As can be seen, for example, in FIG. 3 of the prior art document, a separate radial passage is arranged in the pivot axis for the supply of hydraulic medium to each clearance compensation element. Starting from this radial passage, another separate passage to each clearance compensation element is provided in the lever system. These separate passages disadvantageously increase the costs of manufacture of the entire system. At the same time, since the hydraulic medium is routed through the edge region of the lever system, considerable losses of hydraulic medium can occur, so that the conveying capacity of the hydraulic medium pump has to be increased.

OBJECTS OF THE INVENTION

It is therefore the object of the invention to create a lever of the initially described type in which the mentioned drawbacks are eliminated and in which, particularly, the hydraulic medium losses encountered in the prior art and the costs of manufacture of such hydraulic medium bores are minimized. It is intended at the same time to create a lever by which the gas exchange process of the internal combustion engine is additionally optimized.

SUMMARY OF THE INVENTION

This object is achieved according to the invention by a cam follower of a valve train of an internal combustion engine in the form of a finger lever or a rocker arm for the simultaneous loading of three identically operating gas exchange valves:

- at one end, the finger lever or the rocker arm faces the gas exchange valves with a bottom surface, the finger lever comprising at another end, and the rocker arm comprising approximately centrally, a pivot;
- the finger lever is loadable on a top surface, and the rocker arm is loadable at another end on a bottom surface at least indirectly by at least one cam;
- the finger lever or the rocker arm possesses in the region of the gas exchange valves, hydraulic clearance compensation elements cooperating therewith;
- a passage for hydraulic medium to the clearance compensation elements starts from a bore of the pivot wherein;
- the said passage is configured centrally and extends along or immediately next to a central transverse plane of the lever;
- the clearance compensation elements are connected to one another by a cross-passage in the form of a through-bore, into which cross-passage the passage opens;
- on each side of the central clearance compensation element in the cross-bore, there is fixed a hollow bolt on which a cam-contacting element configured as a rotatable ring is arranged.

Due to the sole central passage now provided by the invention which, further, is particularly intended for use in a lever for loading three identically operating gas exchange valves, the hitherto encountered hydraulic medium losses are strongly minimized. The reason for this, among other things, is that the hydraulic medium supply into the lever system is now no longer effected in the edge region but in the region of a central transverse plane of the cam follower. Thus, the leak gap length at the rotational contact is positively enlarged. Again, the sole oil passage for the supply of hydraulic medium also minimizes the costs of manufacture because the further oil passages can be dispensed with. However, the scope of the invention does not only cover solutions pertaining to levers for the simultaneous loading of three or two gas exchange valves. A larger number of identically operating gas exchange valves is also conceivable.

A simple measure for conveying the hydraulic medium to the individual consumers is a cross-passage in the form of a through-bore is arranged at the end of the central passage, and the clearance compensation elements are disposed in this cross-passage. A configuration is also conceivable in which the axes of the clearance compensation elements are not arranged 100% parallel to the central transverse plane of the lever or do not intersect the cross-passage exactly centrally.

In a further embodiment of the invention, it is proposed to offset the axis of the central hydraulic clearance compensation element from a connecting line of the two outer clearance compensation elements. This measure is required for design space reasons in the respective cylinder head.

It is proposed, at the same time, to arrange the clearance compensation elements in separate ring-like elements which make a finishing treatment of the receptions of the lever superfluous. Advantageously, these elements also serve to seal the cross-bore axially outwardly against an undesired leakage of hydraulic medium and to assure, by an opening arranged therein, an unobstructed flow of hydraulic medium to the clearance compensation elements.

The subject matter of the invention further includes arranging on either side of the central clearance compensation element in the cross-bore, a hollow bolt through whose bore, on the one hand, the hydraulic medium can be conducted to the outer clearance compensation elements in a simple manner. On the other hand, this hollow bolt serves as an advantageous mounting facility for a cam-contacting element configured, for example, as a rolling bearing. However, a sliding contact or sliding mounting of the cam-contacting element is also conceivable.

According to a further proposition of the invention, the finger lever, as seen in a top view, should have a fork-like configuration with the fork ends comprising an annular widening. Due to this fork-like configuration, the cam follower is additionally optimized with regard to its mass and this has a favorable effect on the oscillating masses of the valve train.

The scope of the present invention specifically covers both finger levers and rocker arms but the invention is described herein only with reference to a finger lever system.

BRIEF DESCRIPTION OF THE DRAWINGS

The invention will now be described more closely with reference to the drawings in which.

DETAILED DESCRIPTION OF THE DRAWINGS

Figure 1:
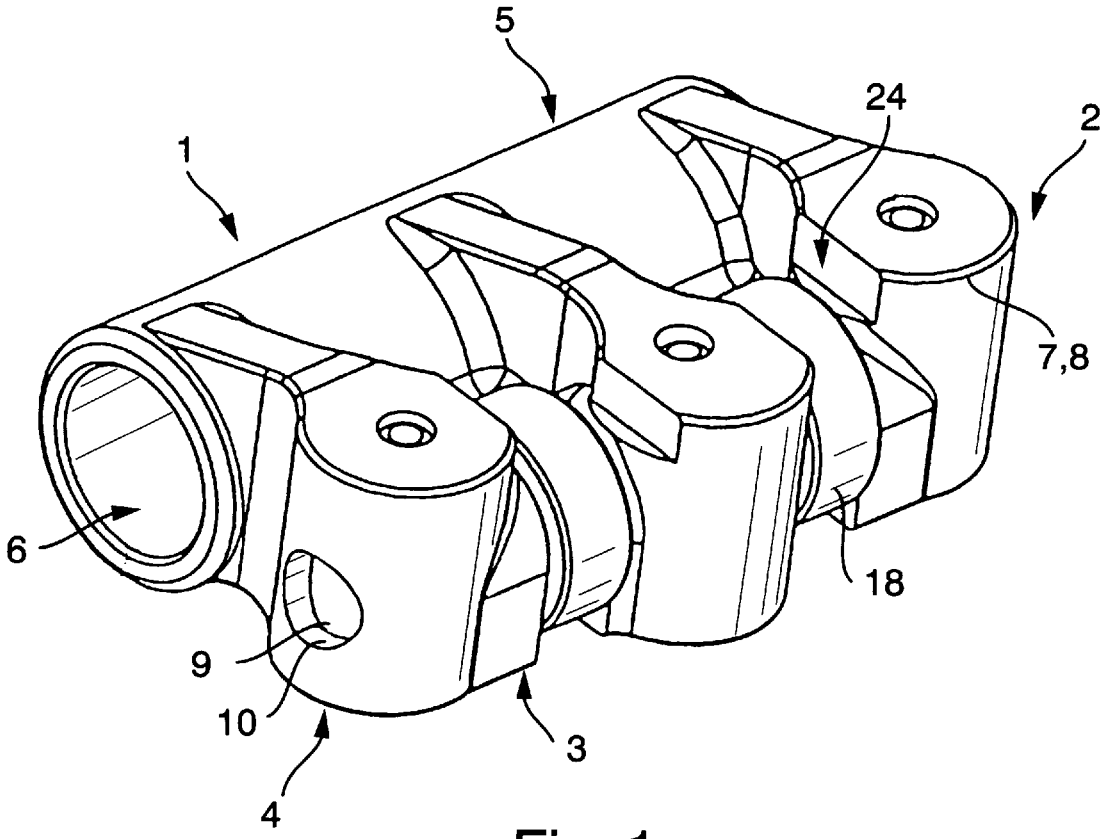
FIG. 1 is a perspective view of a cam follower in the form of a finger lever.

FIG. 1 shows a cam follower in the form of a finger lever 1. This finger lever 1 acts with one of its ends 2 through its bottom surface 3 with the help of three hydraulic clearance compensation elements 4 on valve stem ends of gas exchange valves, not shown, in lifting direction. This finger lever 1 can be configured, for example, to act on inlet valves. With its other end 5, the lever 1 is pivoted through its bore 6 on a pivot, not specifically shown.

As the person skilled in the art can additionally see in FIG. 1, the finger lever 1, as seen in a top view, has a fork-like configuration. The individual fork ends 7 each have a ring-shaped widening 8 for receiving receptions 9, to be discussed hereinafter, for the clearance compensation elements 4.

Figure 2:
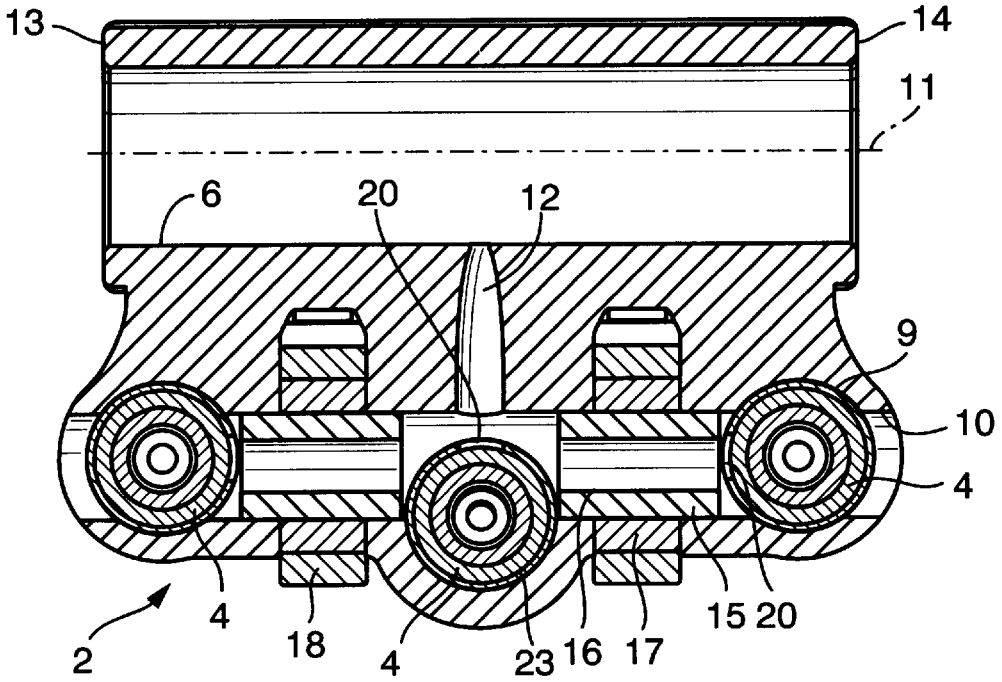
FIG. 2 is a cross-section through the cam follower of FIG. 1 in the region of its cross-bore.

FIG. 2 shows a cross-section through the finger lever 1 in the region of its cross-passage 10. As can be seen in this figure, a central passage 12 starts from the bore 6 of the pivot. This passage 12 extends approximately along a central transverse plane of the finger lever 1. On the side of the end 2 of the finger lever 1, the passage 12 opens into the cross-passage 10. The passages 12, 10 serve to convey hydraulic medium to the clearance compensation elements 4 in the finger lever 1. These clearance compensation elements 4 are arranged respectively at the ends of the bore 10 and in a central position. For one thing, due to the fact that only one central passage 12 starting from the bore 6 is provided in the finger lever 1, the manufacturing thereof is relatively economic. Secondly, as discussed more closely in the introduction, the hydraulic medium losses encountered in the prior art can no longer occur because the passage 12 is arranged axially relatively far away from the front ends 13, 14 of the individual finger lever 1 and the leak gap length is thus relatively large.

FIG. 2 shows further that the central clearance compensation element 4 is axially offset from a connecting line between the outer clearance compensation elements 4 towards the end 2. On either side of the central clearance compensation element 4, there extends in the cross-passage 10, a hollow bolt 15. The bore 16 of the hollow bolt 15 forms a portion of the cross-passage 10 for conducting hydraulic medium to the outer clearance compensation elements 4. A ring 18 is mounted for rotation on each hollow bolt 15 through a rolling bearing 17. This ring 18 is configured as a cam-contacting element. This rolling bearing 17 with the ring 18 thus establishes a low-friction contact of the cam lobe on the finger lever 1.

Figure 3:
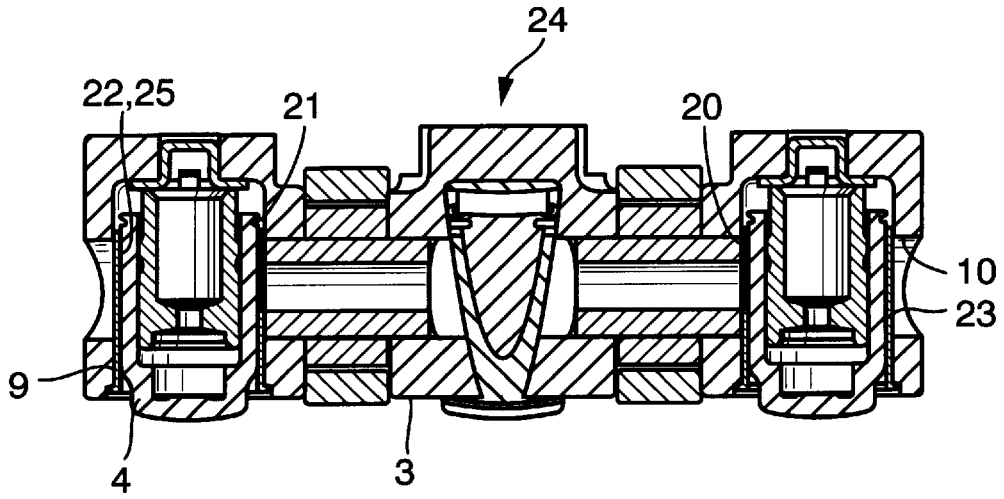
FIG. 3 is a longitudinal section through the cam follower of FIG. 1 along a connecting line between the axes of the two outer clearance compensation elements.

As can likewise be seen in FIGS. 2 and 3, the clearance compensation elements 4 are arranged in receptions 9 which enlarge the diameter of the cross-passage 10. The axes of the two outer receptions 9 extend parallel to the central transverse plane of the finger lever 1 and intersect the axis of the cross-passage 10 approximately at right angles. A ring-like element 23, in which the clearance compensation element 4 is directly arranged, is fixed in each reception 9. In the direction towards the central transverse plane i.e., in the direction towards the passage 12, each element 23 comprises an opening 20. These openings 20 permit a transfer of hydraulic medium from the cross-passage 10 to the interior of the clearance compensation elements 4. At the same time, the elements 23 create a simple closure of the cross-passage 10 axially towards the outside.

The elements 23 can also be made alternatively as a safety device against loss of the clearance compensation elements 4 by having them comprise, for example, on the side of the bottom surface 3, a radially inwards directed collar, not shown, by which the clearance compensation elements 4 are secured particularly during a transport of the finger lever 1. It is equally conceivable, but not specifically shown, to arrange a locking ring in the region of an annular groove 21 on the outer peripheral surface 22 of each clearance compensation element 4, a stop for the locking ring for preventing a loss of the clearance compensation element 4 being formed by the ring-like element 23.

We claim:

1. A cam follower of a valve train of an internal combustion engine in the form a finger lever or a rocker arm for the simultaneous loading of three identically operating gas exchange valves wherein at one end, the finger lever or the rocker arm faces the gas exchange valves with a bottom surface, the finger lever comprising at another end, and the rocker arm comprising approximately centrally, a pivot;

the finger lever is loadable on a top surface, and the rocker arm is loadable at another end on a bottom surface at least indirectly by at least one cam;

the finger lever or the rocker arm possesses in the region of the gas exchange valves, hydraulic clearance compensation elements cooperating therewith;

a passage for hydraulic medium to the clearance compensation elements starts from a bore of the pivot;

wherein said passage is configured centrally and extends along or immediately next to a central transverse plane of the lever;

said clearance compensation elements are connected to one another by a cross-passage in the form of a through-bore, into which cross-passage said passage opens;

on each side of the central clearance compensation element in the cross-passage, there is fixed a hollow bolt on which a cam-contacting element configured as a rotatable ring is arranged.

2. A lever of claim 1 wherein at least the two outer clearance compensation elements extend into receptions of the lever which receptions extend from the bottom surface of the lever parallel to the central transverse plane centrally or approximately centrally in the cross-passage and enlarge the diameter thereof.

3. A lever of claim 2 wherein an axis of the reception of the central clearance compensation element extends parallel to the central transverse plane but outside of the cross-passage offset towards the one end.

4. A lever of claim 2 wherein in each reception, there is fixed a ring-like element in whose bore said clearance compensation elements are disposed, each element comprising at least one opening which communicates with the cross-passage for the direct supply of hydraulic medium to the clearance compensation element concerned.

5. A lever of claim 4 wherein the two axially outer elements are configured and arranged so that they seal the cross-passage axially outwardly.

6. A finger lever of claim 2 wherein, as seen in a top a view, the finger lever has a fork-like configuration, and fork ends thereof comprise an annular widening for the arrangement of the receptions.

7. A lever of claim 1, wherein the rotatable rings are supported on the hollow bolts by a rolling bearing.

8. A lever of claim 7, the rolling elements of the rolling bearing are needles or rollers.

* * * * *